United States Patent [19]

Crawford

[11] 3,954,314

[45] May 4, 1976

[54] PAINT BOX AND EASEL COMBINATION

[76] Inventor: Donald Crawford, 2211 Coronet Blvd., Belmont, Calif. 94002

[22] Filed: Feb. 19, 1974

[21] Appl. No.: 443,370

[52] U.S. Cl. ..... 312/231; 206/1.8; 206/224

[51] Int. Cl.[2] ..... A47B 27/00; A47B 97/04

[58] Field of Search ..... 206/1.7, 1.8, 1.9, 216, 206/223, 224, 229; 312/231; 190/1, 11; 248/447, 448, 449, 454, 455, 456, 461, 463, 465; 35/26

[56] References Cited

UNITED STATES PATENTS

| | | | |
|---|---|---|---|
| 154,583 | 9/1874 | Chorman | 206/1.7 X |
| 275,882 | 4/1883 | Brownell | 312/231 |
| 961,629 | 6/1910 | Maynard | 206/1.7 X |
| 1,065,255 | 6/1913 | Kuhrt | 312/231 |
| 2,586,524 | 2/1952 | Dussardier | 312/231 |
| 2,751,271 | 6/1956 | Dessertenne et al. | 312/231 |
| 3,168,363 | 2/1965 | Monsour | 312/231 |
| 3,202,471 | 8/1965 | Wilson | 312/231 |
| 3,360,319 | 12/1967 | Hocking | 312/231 |
| 3,389,945 | 6/1968 | Thomas | 206/1.7 X |
| 3,514,173 | 5/1970 | Ford | 312/231 |
| 3,540,787 | 11/1970 | Ford | 312/231 |
| 3,580,653 | 5/1971 | Thomas | 312/231 |

FOREIGN PATENTS OR APPLICATIONS

| | | | |
|---|---|---|---|
| 1,406,066 | 11/1965 | France | 312/231 |
| 1,119,347 | 7/1968 | United Kingdom | 312/231 |
| 1,161,277 | 8/1969 | United Kingdom | 206/1.7 |
| 1,005,869 | 4/1952 | France | 248/461 |
| 1,363,532 | 11/1964 | France | 248/461 |

*Primary Examiner*—William Price
*Assistant Examiner*—Stephen Marcus
*Attorney, Agent, or Firm*—Julian Caplan

[57] ABSTRACT

Easel base having compartment for paint tubes and also brushes has a central rib formed with notches. A detachable lid for the base functions as a palette. Hinged to the front edge of the base is an upright member having a bail which fits into any of the rib notches through the base center to adjust the angle of the easel upright relative to the tray. A transverse first channel is fixed to the hinged upright member. An easel extension slides in the upright socket and is fixed in extension by the painting. Slidable on the bar is a second channel which is adjusted in position by a thumb screw. A canvas or other painting surface is supported at its bottom and top edges by the first and second channels. For transportation and storage, the palette lid is placed on the tray, holding the contents in their compartments. The top easel cross bar is inverted and moved down to engage the edge of the palette and base, locking the palette and box closed, thus holding both paints and brushes in the base. The total configuration offers the artist a single compact package for all his painting needs.

6 Claims, 4 Drawing Figures

PAINT BOX AND EASEL COMBINATION

This invention relates to a new and improved paint box and easel combination. More particularly, the invention relates to an easel and paint box comprising a compartmented paint and brush tray and a palette therefor. Hinged to one edge of the tray is a mounted easel. The easel has a channel on its lower edge which receives the bottom edge of a painting, and the top edge is captured by an adjustable channel which slides on the easel extension bar. The angle of the easel bar relative to the tray is adjustable. Hence the device functions as a paint box and also the tray of the paint box functions as the base of an easel for a painting. The enclosing lid is a removable palette. The upper easel clamp is reversible in position; and when in full down position, clamps the tray lid in place for transportation and storage.

One of the features of the invention is the construction of the tray which is compartmented to store paints and brushes. The compartments are thin walled flexible plastic so that they may conform in shape to the shapes of different paint tubes or the changing shape of the tubes as paint is squeezed from them. The compartment walls are elevated to about the upper edge of the tray so that during transportation or storage the paints and brushes do not fall out of the compartments.

Another feature of the invention is the fact that the tray lid is detachable and may function as a palette but further functions to keep the contents in the compartments of the tray while being carried and stored. When the palette is in place as a lid for the tray, it is latched close by the upper easel channel which grips a lip on the tray. The vertical extension bar extends to accept large paintings by sliding vertically through the hinged channel.

Another feature of the invention is the fact that the easel socket forming member is attached to the transverse bottom channel and the bottom channel is hinged at two points to the rim of the tray adjacent the outer edges of the channel. Thereby the easel is rendered more stable. Further, the easel bar extends to accommodate paintings of greater height and the upper channel is adjustable in position for various painting heights.

Another feature of the invention is the fact that when the easel is latched in closed position it may be hung on the wall from a hole in the end of the easel bar or may be stacked in multiples due to the fact that it is flat and of low profile, or hung from hooks under a table or other work area in a classroom or the like. Further, the device is so compact and light in weight that it may be carried by a backpacker or cyclist by straps fitting in holes in the tray.

The tray is preferably shaped tapered rearward to provide a more stable base for larger paintings. As the center of gravity moves rearwardly, the base broadens. Further, the contents of the tray, such as paints, brushes, etc., serve as ballast to further increase the stability of the tray as a stable painting platform.

As a still further feature of the invention, the easel socket is adjustable in angle of elevation relative to the tray in 15° increments by providing a bail on the socket which will fit into any of a plurality of notches in a longitudinal rib in the tray. Nevertheless, the device folds flat for carrying or storage when the bale is removed from all of the notches and the palette lid replaced in position.

Other objects of the present invention will become apparent upon reading the following specification and referring to the accompanying drawings in which similar characters of reference represent corresponding parts in each of the several views.

Figure 2:
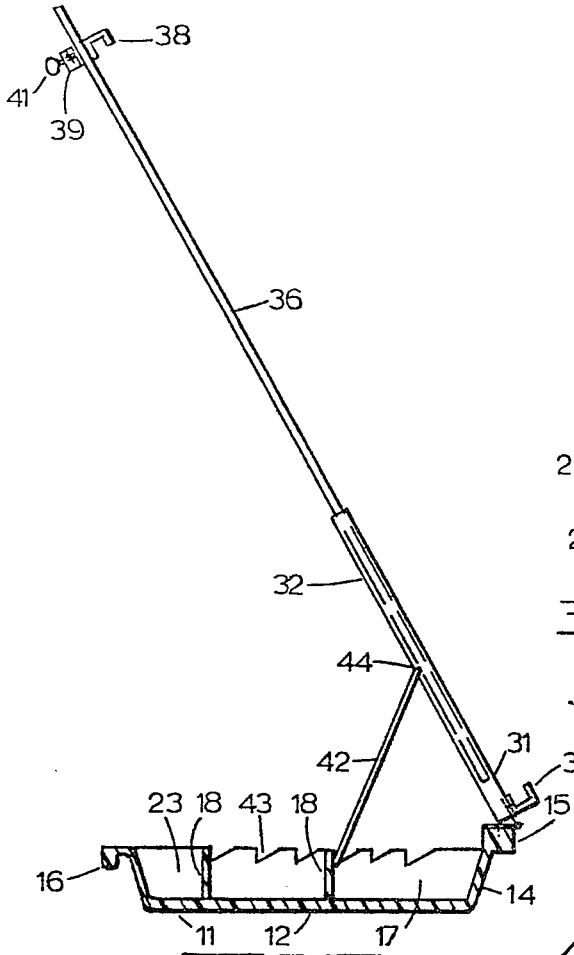
FIG. 2 is a side elevation also partly broken away in section showing the device erect.
Figure 1:
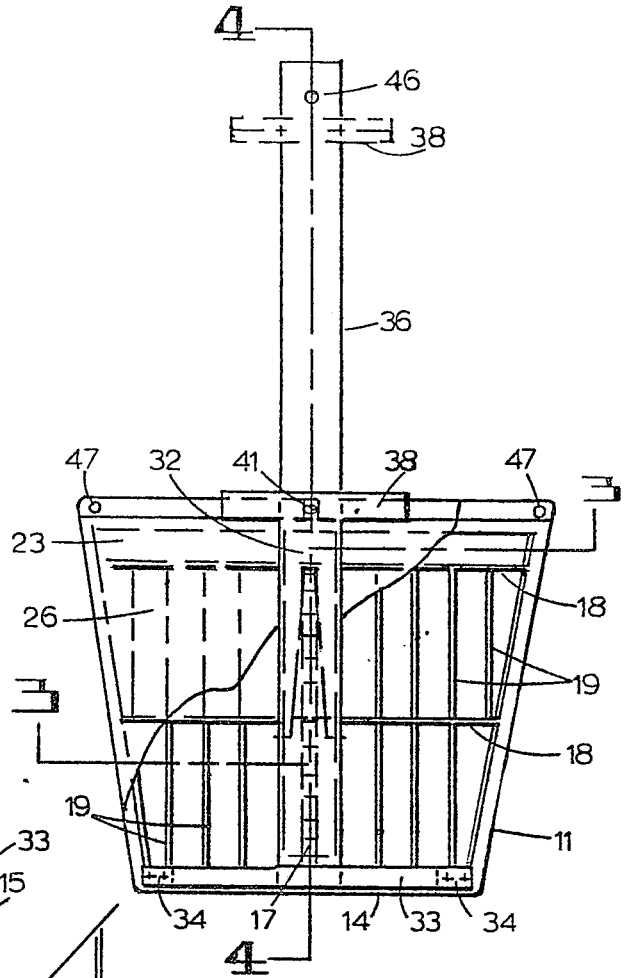
FIG. 1 is a top plan view partly broken away to reveal internal interior construction of the present invention shown collapsed.
Figure 3:
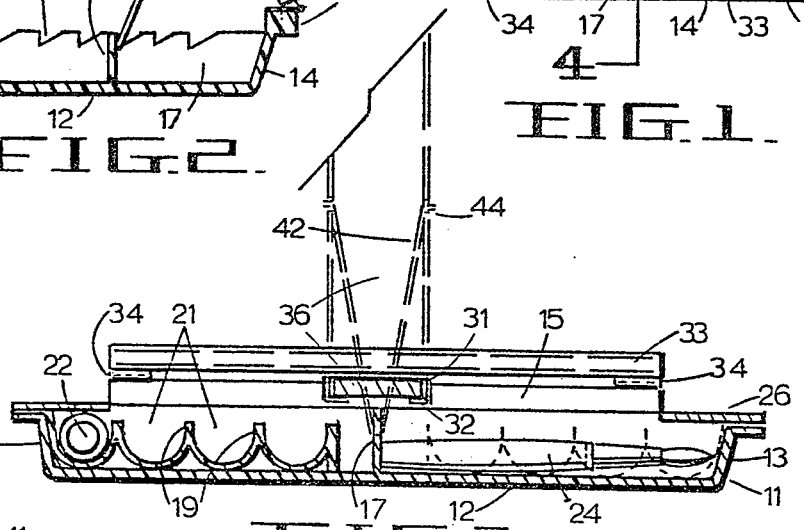
FIG. 3 is a sectional view taken substantially along the line 3—3 of FIG. 1.
Figure 4:
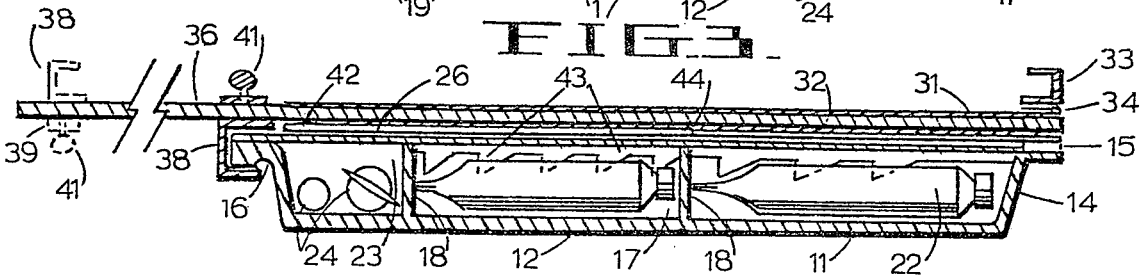
FIG. 4 is a longitudinal sectional view taken substantially along the line 4—4 of FIG. 1 partly broken away to conserve space.

Tray 11 functions both as a receptacle for materials and also as a base of the easel. For such purpose, it is provided with a substantially flat bottom 12 which is preferably trapezoidal in shape, broadening rearward, having outwardly slanted side edges 13 formed with peripheral rims on their upper edges. Front edge 14 slants upwardly-outwardly and is formed with an enlarged upward extending protrusion 15. The rear edge of tray 11 is formed with a lip 16 as best shown in FIGS. 2 and 4. Extending from the front to adjacent the rear is a central longitudinal rib 17. Transverse dividers 18 are also provided. Compartment forming members 21, which are preferably curved (see FIG. 3), divide the area forward of the forwardmost divider 18 into a plurality of compartments 21 for tubes 22. The area between the rearmost compartment 18 and the rear edge 16 provides a compartment 23 for brushes 24. It will be noted that the rib 17 and dividers 18 and 19 extend up to about the top edge of tray 11. A lid 26 fits on top of the tray 11 and, cooperating with the dividers 18, 19 and rib 17, prevents tubes 22, brushes 24, etc. from falling out of their respective compartments during transportation and storage. The means whereby the lid 26 is held in place is hereinafter described. Lid 26 is completely detachable from tray 11; and when detached, may function as a paint mixing palette.

A socket forming member 31 hinges rearward from the front edge 14 overlying rib 17. Socket forming member 31 here shown comprises a shallow channel with inturned edges 32. Fixed to the lower end of socket forming member 31 is a transversely extending lower channel 33 which functions to hold the lower edge of a painting. The channel 33 is as wide as the front edge 14 and is hinged to projection 15 at its outer ends by hinges 34 thereby improving the stability of the device. Slidable in socket forming member 31 is easel bar 36. Slidable on bar 36 is transverse upper channel 38 which is connected to a slide 39 which slides on the bar 36 and is held in positions of adjustment by thumb screw 41. The distance between channels 33 and 38 is adjustable so that both the bottom and top edges of a painting are held by the two channels. The angle of member 31 and bar 36 relative to tray 11 is adjustable. A preferred means for this adjustment is the provision of a wire bail 42 which fits into any of a plurality of notches 43 formed in the upper edge of rib 17 and is attached to member 31 by hinge points 44 integral therewith.

To hold the tray in closed position, the channel 38 is reversed from the position shown in FIG. 2 and slid down the bar 36 until the channel 38 engages the lip 16 on the rear edge of tray 11. In this position, the lid 26 is latched in place keeping the contents of tray 11 secure. The combination may be hung from a nail or other support by means of hole 46 in the outer end of bar 36. Alternatively, a strap may be fastened in the holes 47 in the rear edges of lip 16. Since the device is very compact and flat, pluralities of the devices may be stacked conveniently.

It will be seen that the tray 11 is broader at its rear than at the forward end which provides for stability in supporting the easel function of the device. Further, the tubes and brushes in their various compartments 21, 23 provide ballast for the tray, the removable palette acting as a lid enclosure locked in place by channel 38 in inverted position when clasped by rear lip 16.

What is claimed is:

1. A paint box easel combination, comprising an open top tray formed with dividers into a plurality of compartments for paints, brushes and the like, a palette lid dimensioned substantially as large as said tray and shaped to form a cover for said tray when positioned on top of said tray, said dividers elevated to close proximity to said palette lid when said lid is on top of said tray, said palette lid being totally removable from said tray and also being capable of being placed on top of said tray, a socket forming member having a width substantially less than the width of said tray, means hingedly connecting said member to one edge of said tray, an easel upright extension bar fitting in said member, and latch means on said bar cooperating with said tray to fit over the outside of said palette lid when said palette lid is placed on top of said tray to hold said palette lid in close contact with said tray and completely covering said tray, whereby said palette lid comprises the sole cover for said tray.

2. The combination of claim 1 in which said member has a bail pivoted thereto and one of said dividers extends longitudinally down the center of said tray and is formed with spaced notches to receive said bail in different angles of adjustment of said bar relative to said tray.

3. The combination of claim 1 in which said dividers are formed of flexible plastic to accept changing paint tube forms.

4. The combination of claim 1 in which the side edges of said tray slant outwardly-rearwardly, said tray functioning as a base for said easel, with paint tubes acting as ballast, the total unit forming a complete portable paint box easel and equipment combination.

5. The combination of claim 1 which further comprises a first channel on the lower end of said member for the lower edge of a painting, and a second channel slideable on said upright bar for the upper end of said painting.

6. The combination of claim 5 in which said second channel is reversible in position and when reversed and slid down said bar engages a second edge of said tray to hold said palette lid in closed position, said second channel and said second edge comprising said latch means.

* * * * *